US009266323B2

(12) United States Patent
Reinten

(10) Patent No.: US 9,266,323 B2
(45) Date of Patent: Feb. 23, 2016

(54) OPERATING A PIEZOELECTRIC ACTUATOR MEMBRANE OF A PRESSURE CHAMBER

(71) Applicant: OCE TECHNOLOGIES B.V., Venlo (NL)

(72) Inventor: Hans Reinten, Velden (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 299 days.

(21) Appl. No.: 13/783,501

(22) Filed: Mar. 4, 2013

(65) Prior Publication Data

US 2013/0177449 A1 Jul. 11, 2013

Related U.S. Application Data

(63) Continuation of application No. PCT/EP2011/072924, filed on Dec. 15, 2011.

(30) Foreign Application Priority Data

Dec. 21, 2010 (EP) ..... 10196183

(51) Int. Cl.
*B41J 2/045* (2006.01)
*F04B 43/04* (2006.01)
*B41J 2/14* (2006.01)

(52) U.S. Cl.
CPC ..... *B41J 2/04581* (2013.01); *B41J 2/04588* (2013.01); *B41J 2/14233* (2013.01); *F04B 43/043* (2013.01)

(58) Field of Classification Search
CPC .. F04B 43/043; F04B 43/046; B41J 2/04581; B41J 2/04541; B41J 2/04588; B41J 2/04568
USPC ..... 310/317, 324, 328
See application file for complete search history.

(56) References Cited

U.S. PATENT DOCUMENTS

| | | | | |
|---|---|---|---|---|
| 5,266,965 | A * | 11/1993 | Komai et al. | 347/12 |
| 2002/0140784 | A1* | 10/2002 | Takahashi | 347/72 |
| 2002/0149638 | A1* | 10/2002 | Sumi | 347/10 |
| 2003/0142173 | A1 | 7/2003 | Takahashi | |

(Continued)

FOREIGN PATENT DOCUMENTS

| | | | |
|---|---|---|---|
| EP | 2 042 321 | A1 | 4/2009 |
| JP | 1-283154 | A | 11/1989 |

(Continued)

*Primary Examiner* — Devon Kramer
*Assistant Examiner* — Kenneth J Hansen
(74) *Attorney, Agent, or Firm* — Birch, Stewart, Kolasch & Birch, LLP

(57) ABSTRACT

A method of controlling a pressure of a fluid in a pressure chamber, which pressure chamber is delimited by an actuator membrane having a first piezoelectric portion arranged in a central zone of the actuator membrane and at least one second piezoelectric portion arranged in at least one peripheral zone of the actuator membrane; and an ink jet printing device. In a neutral stage, a first flexure state of the actuator membrane is provided by applying first and second voltages to respective piezoelectric portions. In an activation stage, the first and second voltages are temporarily varied, without reversing their polarity, such that a curvature of the central part of the actuator membrane and a curvature of the peripheral part of the actuator membrane are changed in opposite directions, in order to expell a droplet of fluid through a nozzle.

20 Claims, 3 Drawing Sheets

(56) References Cited

U.S. PATENT DOCUMENTS

2008/0074474 A1 3/2008 Yoo et al.
2009/0085984 A1* 4/2009 Kojima ..... 347/68

FOREIGN PATENT DOCUMENTS

JP 2008-105405 A 5/2008
JP 2008-238469 A 10/2008

* cited by examiner

OPERATING A PIEZOELECTRIC ACTUATOR MEMBRANE OF A PRESSURE CHAMBER

This application is a Continuation of PCT International Application No. PCT/EP2011/072924 filed on Dec. 15, 2011, which claims priority under 35 U.S.C §119(a) to Patent Application No. 10196183.7 filed in Europe on Dec. 21, 2010, all of which are hereby expressly incorporated by reference into the present application.

BACKGROUND OF THE INVENTION

1. Field of the Invention

The invention relates to a method of controlling a pressure of a fluid pressure chamber, in particular a pressure chamber of an ink jet print head, which pressure chamber is delimited by an actuator membrane. Furthermore, the invention relates to an ink jet printing device, comprising a pressure chamber and an actuator membrane delimiting the pressure chamber.

2. Description of Background Art

EP 2 042 321 A1 describes a piezoelectric actuator having a first active portion, which corresponds to a central portion of each of pressure chambers, and a second active portion which corresponds to a portion of each of the pressure chambers, located on outer circumferential sides with respect to the central portion. A deformation of the first and second active portions is generated in opposite directions. The deformation of the first active portion, which is brought about to discharge the liquid in a certain pressure chamber among the pressure chambers, is cancelled by the deformation of the second active portion, when the deformation of the first active portion is propagated to another pressure chamber adjacent to the certain pressure chamber, in order to suppress crosstalk even when a high density arrangement of the pressure chambers is realized. The first active portion is polarized in a direction parallel to the electric field generated in the first active portion, and the second active portion is polarized in a direction opposite to the electric field generated in the second active portion.

SUMMARY OF THE INVENTION

An efficiency of deforming a piezoelectric layer by an electric field, also referred to as a piezoelectric effect, depends on a degree of polarization of the piezoelectric material. However, when a voltage is provided between top and bottom electrodes of a piezoelectric layer such that the resulting electric field in the piezoelectric layer is opposed to the piezoelectric polarization of the piezoelectric layer, deterioration of the polarization may occur. As a result, the piezoelectric efficiency of the piezoelectric layer and thus, the efficiency of the actuator, will decrease.

For reasons of efficiency of bending or flexing of the actuator membrane, it is also desirable to have a thin piezoelectric layer. However, in a thin piezoelectric layer, the polarization will deteriorate quickly, if a resulting electric field in the piezoelectric layer is opposed to the polarization of the piezoelectric layer.

It is an object of the invention to provide a method of controlling a pressure of a fluid in a pressure chamber with an actuator membrane having an improved actuation efficiency.

In order to facilitate achieving this object, according to the invention, there is provided a method of controlling a pressure of a fluid, in particular a liquid, in a pressure chamber, which pressure chamber is delimited by an actuator membrane, wherein the actuator membrane comprises a first piezoelectric part arranged in a central part of the actuator membrane and at least one second piezoelectric part arranged in at least one peripheral part of the actuator membrane, the method comprising:

a neutral stage for providing a first flexure state of the actuator membrane, the neutral stage comprising: applying a first voltage to the first piezoelectric part, thereby generating a first electric field in the first piezoelectric part; and applying a second voltage to the second piezoelectric part, thereby generating a second electric field in the second piezoelectric part; and an activation stage for temporarily providing a second flexure stage of the actuator membrane, the activation stage comprising: temporarily varying the first voltage and the second voltage, without reversing a polarity of the first voltage and without revising a polarity of the second voltage, such that a curvature of the central part of the actuator membrane and a curvature of the at least one peripheral part of the actuator membrane are changed in opposite directions. For example, one of the first and second flexure states may be a substantially flat state of the actuator membrane.

The first piezoelectric part, as well as the central part of the actuator membrane, corresponds to a central portion of the pressure chamber, and the at least one second piezoelectric part, as well as the at least one peripheral part of the actuator membrane, corresponds to at least one portion of the pressure chamber, located on outer circumferential sides with respect to the central portion of the pressure chamber. Such a central portion of the pressure chamber does not necessarily coincide with a centre of the pressure chamber. Further, the second piezoelectric part as well as the at least one peripheral part of the actuator membrane may extend outside the circumference of the pressure chamber such that the second piezoelectric part is only partially arranged over the pressure chamber.

The first voltage is temporarily varied without reversing its polarity. That is, the first voltage assumes only values of a single polarity or zero. Also, the second voltage is temporarily varied without reversing a polarity of the second voltage. That is, the second voltage also assumes only values of a single polarity or zero. Thus, there is no zero-crossing of the first and second voltages when going from the neutral stage to the activation stage and temporarily varying the first and second voltages in the activation stage.

Because, in the activation stage, the first voltage is temporarily varied without reversing a polarity of the first voltage, and the second voltage is temporarily varied without reversing a polarity of the second voltage, it can be avoided to generate an electric field in the first or second piezoelectric part opposed to the piezoelectric polarization of the respective piezoelectric part. Thus, it is avoided that the piezoelectric efficiency of the piezoelectric parts degrades over time and thereby the piezoelectric efficiency is improved compared to the prior art. The curvatures of the central part of the actuator membrane and of the peripheral part of the actuator membrane may be changed in opposite directions while avoiding generating an electric field in the respective piezoelectric part opposed to the respective polarization of the piezoelectric part. Therefore, the deflection efficiency of the actuator membrane is particularly improved. Furthermore, for example, a piezoelectric polarization of the respective piezoelectric part may be maintained throughout the neutral stage and the activation stage. Thus, the piezoelectric efficiency is improved.

In the features of applying said first and second voltages to the respective first and second piezoelectric parts, the term "voltage" is used to define a voltage between opposite sides, e.g. electrodes, of the respective piezoelectric part. As used herein, the term "voltage" may include a voltage of 0 V (zero), and the term "electric field" may include a field of zero field strength.

For example, in the second flexure state, the actuator membrane is deflected towards the inside of the pressure chamber. Thereby, a pressure of the fluid in the pressure chamber is increased and, for example, a fluid droplet is ejected from a nozzle being in fluid communication with the pressure chamber. For example, in the activation stage, the first voltage and the second voltage are temporarily varied such that a resulting pressure wave in the pressure chamber provides for expelling a droplet of fluid through said nozzle.

For example, the first and second piezoelectric parts of the actuator membrane are arranged to be operated in a flexural deformation mode. That is, when a voltage is applied between top and bottom electrodes of the respective piezoelectric part, at least a respective layer of the respective piezoelectric part extends or contracts in a lateral direction, thereby causing the actuator membrane to flex, i.e. bend.

For example, the actuator membrane is connected to side walls of the pressure chamber. For example, the pressure chamber is formed in a chamber plate, to which the actuator membrane is connected. In the flexural deformation mode, the bending of the actuator membrane close to the side walls of the pressure chamber may be at least partly restrained due to said mechanical attachment of the actuator membrane to the side walls. By changing the curvature of the central part of the actuator membrane and the curvature of the peripheral part of the actuator membrane in opposite directions, the amount of deflection of the central part may be increased. Furthermore, crosstalk within a dense arrangement of pressure chambers may be reduced. Furthermore, deformation of the side walls of the pressure chamber due to the deformation of the actuator membrane may be reduced.

For example, the first piezoelectric part and second piezoelectric part are first and second piezoelectric layer portions. For example, the piezoelectric layer portions are piezoelectric ceramic layer portions. For example, the piezoelectric layer portions are piezoelectric lead zirconate titanate (PZT) layer portions. Lead zirconate titanate is a ceramic compound of lead, oxygen and titanium and/or zirconium, which is commonly used for manufacturing piezoelectric actuators due to its piezoelectric effect.

Polarizing the piezoelectric material of the piezoelectric parts may be carried out by providing a strong electric field in the direction of the desired polarization. The polarization process may be accelerated by heating the piezoelectric material to a higher temperature. A polarization process of the piezoelectric material is commonly carried out in a fabrication step of the actuator, for example before or after assembling the actuator, such that the required polarization of the piezoelectric material is obtained. However, a polarization of a respective piezoelectric part may be also provided or generated during operation of the actuator membrane, e.g. by applying a voltage to the respective piezoelectric part.

Further embodiments of the invention are indicated in the dependent claims.

In one embodiment, the actuator membrane comprises at least one membrane layer, the first and second piezoelectric parts being arranged on one side of said at least one membrane layer. This allows a particularly simple structure of the actuator membrane. For example, the at least one membrane layer is arranged at a pressure chamber side of the actuator membrane. For example, such membrane layer is inert with respect to the fluid in the pressure chamber.

For example, the activation stage comprises: temporarily decreasing an absolute value of one of the first voltage and the second voltage, and temporarily increasing an absolute value of the other one of the first voltage and the second voltage, without reversing a polarity of the first voltage and without reversing a polarity of the second voltage, such that a curvature of the central part of the actuator membrane and a curvature of the peripheral part of the actuator membrane are changed in opposite directions. In other words, temporarily varying the first and second voltages may comprise temporarily decreasing an absolute value of one of the first and second voltages and temporarily increasing an absolute value of the other one of the first and second voltages. In one embodiment, for example, temporarily varying the first and second voltages may consist of temporarily decreasing an absolute value of one of the first and second voltages and temporarily increasing an absolute value of the other one of the first and second voltages. Accordingly, the resulting electric field in one of the first and second piezoelectric parts is decreased, whereas the resulting electric field in the other piezoelectric part is increased. Thereby, the curvatures of the central part and the peripheral part of the actuator membrane may be changed in opposite directions, although the first and second piezoelectric parts may be arranged on a same side of a membrane layer. Furthermore, it may be avoided to reverse a polarity of an electric field in the respective first and second piezoelectric parts. Thus, for example, the piezoelectric parts may maintain a respective polarization. Furthermore, the structure of the actuator membrane may be simplified.

In one embodiment, the actuator membrane comprises a first constant potential electrode, at least one second constant potential electrode, and a signal electrode, wherein the first piezoelectric part is arranged between the first constant potential electrode and the signal electrode, and wherein the second piezoelectric part is arranged between the second constant potential electrode and the signal electrode. For example, the first voltage is applied between the first constant potential electrode and the signal electrode, and the second voltage is applied between the signal electrode and the second constant potential electrode. For example, the first voltage corresponds to a potential difference between the first constant potential electrode and the signal electrode, and the second voltage corresponds to a potential difference between the signal electrode and the second constant potential electrode. The described structure with first and second constant potential electrodes and a common signal electrode for the first and second piezoelectric parts is particularly advantageous in that it allows to change the first and second voltages through a single signal electrode. Moreover, the single signal electrode allows to simultaneously decrease one of the first and second voltages and increase the other one of the first and second voltages.

For example, in an aspect of the invention, there is provided an arrangement of pressure chambers as described above, each pressure chamber being delimited by a respective actuator membrane comprising respective first and second piezoelectric parts arranged in a central part of the actuator membrane and in a peripheral part of the actuator membrane, respectively. The arrangement may comprise a first constant potential electrode common to respective first piezoelectric parts of the actuator membranes and at least one second constant potential electrode, common to the respective second piezoelectric parts of the respective actuator membranes, and individual signal electrodes may be provided for the actuator membranes. Thus, only one signal electrode is required per pressure chamber and, thus, per nozzle of an ink jet print head comprising such arrangement of pressure chambers.

Having a first constant potential electrode, at least one second constant potential electrode and a signal electrode as described above is particularly advantageous when the first and second piezoelectric parts are arranged on one side of at least one membrane layer of the actuator membrane. Thus, the structure of the actuator membrane may be simplified further.

For example, the method may comprise applying a bias voltage between the first and second constant potential electrodes, and may comprise applying a signal to the signal electrode that is limited to a range from a constant potential of the first constant potential electrode to a constant potential of the second constant potential electrode. Thus, control of the first and second voltages is simplified. In particular, for example, an absolute value of one of the first voltage and the second voltage may be temporarily decreased, and an absolute value of the other one of the first voltage and the second voltage may be temporarily increased, without reversing a polarity of the first voltage and without reversing a polarity of the second voltage.

Moreover, for example, the bias voltage may facilitate maintaining a respective polarization of the respective piezoelectric parts.

For example, the signal may be applied to the signal electrode for applying said first and second voltages to the respective first and second piezoelectric parts, and for temporarily varying the first and second voltages as described above. In another example, the signal may be applied to the signal electrode in the activation stage only, for temporarily varying the first voltage and the second voltage. For example, no signal is applied to the signal electrode during the neutral stage. For example, the signal electrode may be floating during the neutral stage. For example, in the neutral stage, the first and second voltages are applied resulting from dividing the bias voltage. In other words, there is a series connection of the first and second piezoelectric parts through the first constant potential electrode, the first piezoelectric part, the signal electrode, the second piezoelectric part and the second constant potential electrode.

In one embodiment, the first and second piezoelectric parts are polarized, during at least one of the neutral stage and the activation stage, in mutually opposite directions. For example, the first piezoelectric part is polarized in a first direction transverse to the actuator membrane, and the at least one second piezoelectric part is polarized in the opposite direction transverse to the actuator membrane. Since the polarity of the applied first and second voltages is not reversed, the polarization of the respective piezoelectric parts may be maintained. This is particularly advantageous when the actuator membrane comprises at least one membrane layer, and the first and second piezoelectric parts are arranged on one side of the at least one membrane layer, and the actuator membrane comprises a common signal electrode of the first and second piezoelectric parts as described above. The control of the first and second voltages is simplified, and the structure of the actuator membrane is further simplified. For example, the first and second piezoelectric parts may be arranged on one side of the signal electrode, wherein the signal electrode and the respective first and second constant potential electrodes are arranged on opposite sides of the respective piezoelectric part. For example, the first and second constant potential electrodes may be arranged adjacent to each other in one plane or layer of the actuator membrane.

In one embodiment, the first and second piezoelectric parts have thicknesses of at most 10 μm (micrometers), preferably at most 5 μm. Thus, a high flexing efficiency may be achieved. Furthermore, avoiding a deterioration of the polarization of the piezoelectric parts is particularly advantageous in case of such thin piezoelectric layers.

For example, the actuator membrane has a thickness of at most 10 μm (micrometers), preferably at most 5 μm. Thus, a high flexing efficiency may be achieved.

For example, the actuator membrane comprises a single piezoelectric layer element, said single piezoelectric layer element comprising the first piezoelectric part and the at least one second piezoelectric part arranged next to each other. For example, the single piezoelectric layer element may be partly polarized in a first direction for providing the first piezoelectric part and partly polarized in a second direction for providing the second piezoelectric part. For example, the second direction is opposite to the first direction.

In a further aspect of the invention, there is provided an ink jet printing device, comprising:

a pressure chamber, an actuator membrane delimiting the pressure chamber, wherein the actuator membrane comprises a first piezoelectric part arranged in a central part of the actuator membrane and at least one second piezoelectric part arranged in at least one peripheral part of the actuator membrane, and a control unit arranged for applying a first voltage to the first piezoelectric part and applying a second voltage to the second piezoelectric part for providing a first flexure state of the actuator membrane, wherein the control unit is arranged for temporarily varying the first voltage and the second voltage, without reversing a polarity of the first voltage and without reversing a polarity of the second voltage, such that a curvature of the central part of the actuator membrane and a curvature of the at least one peripheral part of the actuator membrane are changed in opposite directions, thereby temporarily providing a second flexure state of the actuator membrane. For example, the control unit is adapted to perform the method of any one of the examples described above. The printing device is, for example, a printer, a copier, etc.

For example, the control unit is arranged to alternately providing said first flexure state an said second flexure state of the actuator membrane in accordance with image information provided to the control unit.

For example, the pressure chamber is in fluid communication with a nozzle, and the control unit is arranged for temporarily varying the first voltage and the second voltage, without reversing a polarity of the first voltage and without reversing a polarity of the second voltage, such that a resulting pressure wave in a fluid in the pressure chamber provides for expelling a droplet of fluid through said nozzle.

For example, the actuator membrane comprises a first constant potential electrode, at least one second constant potential electrode, and a signal electrode that is connected to the control unit, wherein the first piezoelectric part is arranged between the first constant potential electrode and the signal electrode, and wherein the second piezoelectric part is arranged between the second constant potential electrode and the signal electrode, and wherein the ink jet printing device further comprises a bias voltage supply unit connected to the first and second constant potential electrodes for providing a bias voltage between the first and second constant potential electrodes, and wherein the control unit is adapted to at least temporarily provide a signal to the signal electrode for providing said first voltage between the first constant potential electrode and the signal electrode, and providing said second voltage between the second constant potential electrode and the signal electrode. For example, the signal is provided only and/or at least for temporarily varying the first voltage and the second voltage as described above, e.g. in the activation stage of the above described method. However, a signal may also be provided during the neutral stage.

For example, the actuator membrane comprises at least one membrane layer, the first and second piezoelectric parts being arranged on one side of said at least one membrane layer.

For example, the first and second piezoelectric parts are polarized in mutually opposite directions.

BRIEF DESCRIPTION OF THE DRAWINGS

The present invention will become more fully understood from the detailed description given herein below and accompanying drawings which are given by way of illustration only and are not limitative of the invention, and wherein.

DETAILED DESCRIPTION OF THE PREFERRED EMBODIMENTS

Figure 1:
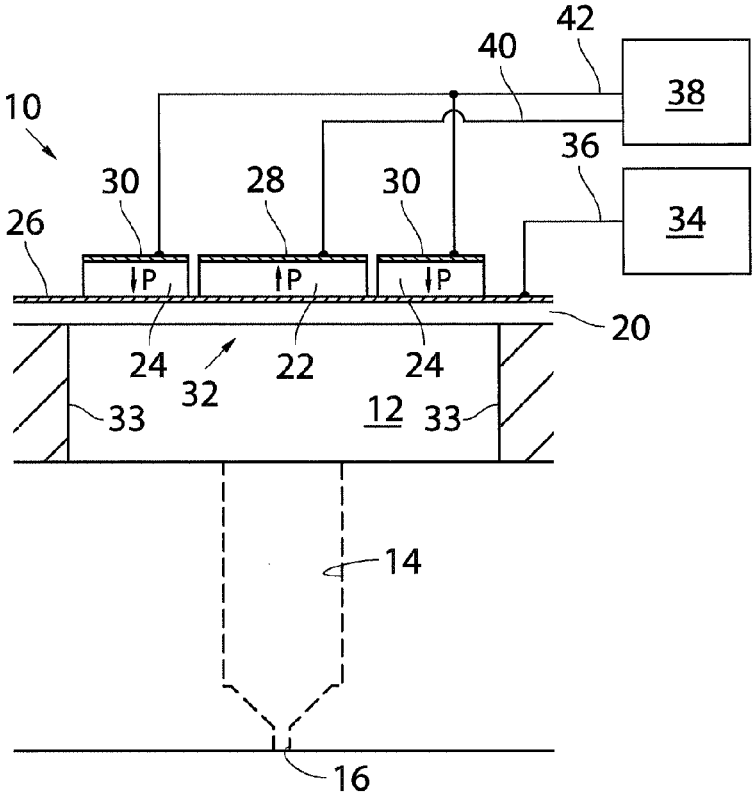
FIG. 1 is a schematic cross sectional partial view of a pressure chamber and an actuator membrane of a print head, as well as a control unit and a bias voltage supply unit of an ink jet printing device.

In FIG. 1, a part of an ink jet print head 10 is shown having a pressure chamber 12 which is connected via a feedthrough 14 to a print head nozzle 16. Ink is supplied to the pressure chamber 12 through an inlet, which is e.g. connected to a common ink supply channel of several pressure chambers 12. The pressure chamber 12 is, in a use state, filled with ink, for example, hot melt ink in its liquid state.

The illustrated pressure chamber is of general cuboid shape, but may in practice have any other suitable shape. A substantial part of a top wall of the pressure chamber 12 is formed by a membrane layer 20. Thus, the membrane layer 20 delimits the pressure chamber 12. Several pressure chambers 12 of the print head 10 may have respective membrane layers 20 formed by a common substrate.

Whereas a first side of the membrane layer 20 defines an interior wall of the pressure chamber 12, a first piezoelectric layer portion 22 and two second piezoelectric layer portions 24 are arranged on a second side of the membrane layer 20. A signal electrode 26 is provided between the membrane layer 20 and the piezoelectric parts 22, 24. The signal electrode 26 forms a common lower electrode for the piezoelectric parts 22 and 24. A first constant potential electrode 28 forms an upper electrode of the first piezoelectric part 22, and second constant potential electrodes 30 form upper electrodes of respective second piezoelectric parts 24. Thus, the first piezoelectric part 22 is arranged between the signal electrode 26 and the first constant potential electrode 28. Each second piezoelectric part is arranged between the signal electrode 26 and the second constant potential electrode 30. The terms "upper" and "lower" are used with respect to the membrane layer, a lower electrode being closer to the membrane layer than an upper electrode. The second constant potential electrodes 30 are connected with each other.

The membrane layer 20 and the layers of the piezoelectric parts 22, 24 and electrodes 26, 28, 30 form an actuator membrane 32. The first piezoelectric part 22 is arranged in a central part of the actuator membrane 32 above the pressure chamber 12, and the second piezoelectric parts 24 are arranged adjacent to the first piezoelectric part 22 in a peripheral part of the actuator membrane 32 on two sides of the central part. For example, the first and second piezoelectric parts 22, 24 may extend parallel to each other in a first lateral extension of the membrane layer 20, e.g. perpendicular to the drawing plane of FIG. 1. Whereas the first piezoelectric part 22 is arranged in the central part of the actuator membrane 32, the second piezoelectric parts 24 are arranged closer to side walls 33 of the pressure chamber 12.

The first constant potential electrode 28 may be connected to respective first constant potential electrodes 28 of actuator membranes 32 of other pressure chambers 12 of the print head. For example, the first constant potential electrodes 28 may be connected in a comb-like shape. Likewise, second potential electrodes 30 of several actuator membranes 32 may be connected with each other, e.g. forming a comb-like shape.

For example, the membrane layer 20 is formed by a silicon nitride ($Si_3N_4$) substrate. The membrane layer 20 may also be formed by a silicon based substrate, on which e.g. surface oxide layers have been formed. The first and second piezoelectric parts 22, 24 are formed, for example, of lead zirconate titanate (PZT). The electrodes 26, 28 and 30 are, for example, formed of a metal as is known in the art.

For example, the membrane layer 20 is a flexible sheet of material. The material and the thickness of the membrane layer 20 may be selected to have a suitable elasticity for providing for suitable bending of the membrane layer. The first and second piezoelectric parts 22, 24 are e.g. rigidly connected to the membrane layer 20, for example via the signal electrode 26 and/or other components, such as an adhesive layer. An expansion or contraction of the piezoelectric parts 22, 24 in a direction parallel to the plane of the actuator membrane 32 will result in a bending force in the actuator membrane 32. Thus, each of the first and second piezoelectric parts 22, 24 forms a bimorph piezoelectric actuator with a respective corresponding portion of the membrane layer 20.

For example, the thickness of the piezoelectric parts is similar to the overall thickness of the at least one membrane layer 20. For example, the thickness of the piezoelectric parts 22, 24 is of in the range of 2 μm to 3 μm. For example, the overall thickness of the actuator membrane 32 is at most 5 μm.

The printing device comprises a control unit having a signal output 36 connected to the signal electrode 26. Further, the printing device comprises a bias voltage supply unit 38 having a first constant potential output 40 connected to the first constant potential electrode 28, and a second constant potential output 42 connected to the second constant potential electrodes 30. For example, the second constant potential output 42 is connected to ground.

The first and second piezoelectric parts 22,24 are polarized in opposite directions. Said directions are transverse to the plane of the actuator membrane 32. The polarizations are indicated in FIG. 1 by arrows P. For example, the first piezoelectric part may be polarized in a first direction from the signal electrode 26 to the electrode 28. The second piezoelectric parts 24 are polarized in the opposite direction, from the electrodes 30 to the signal electrode 26. For example, the polarizations may be generated during manufacturing of the actuator membrane 32.

During printing, control of the actuator membrane 32 is as follows.

During printing, the actuator membrane 32 is alternately brought into a neutral stage for providing a first flexure state of the actuator membrane 32, and an activation stage for temporarily providing a second flexure state of the actuator membrane 32, thereby deflecting the actuator membrane 32 towards the inside of the pressure chamber 12. Thereby, a pressure wave is generated in the pressure chamber, such that a droplet of the ink is discharged through the nozzle 16.

Figure 3:
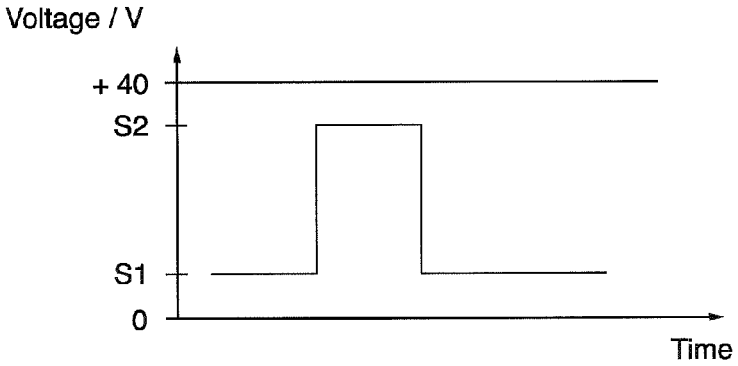
FIG. 3 is a schematic graph of a bias voltage and a signal for controlling the actuator membrane.

During the neutral stage and the activation stage, the bias voltage supply unit 38 applies a constant bias voltage between the first and second constant potential electrodes 28, 30. For example, the first constant potential electrode 28 is grounded, i.e. set to 0 V. For example, the second constant potential electrodes 30 are set to a positive voltage level of +40 V with respect to the first constant potential electrode 28. A first signal voltage level S1 is applied to the signal electrode 26 by the control unit 34, as is schematically indicated in FIG. 3, such that the resulting electric fields in the respective piezoelectric parts 22, 24 are in the direction of the respective polarization. Thus, the polarization may be maintained. For example, the signal that is applied to the signal electrode 26 is closer to the first constant electric potential (ground) than to the second constant potential of +40 V, as shown in FIG. 3.

In the neutral stage, the actuator membrane 32 assumes a first flexure state. For example, the bending forces resulting from the electric fields in the piezoelectric parts 22, 24 may approximately cancel each other, and the actuator membrane 32 may assume a substantially flat configuration. That is, the first flexure state is e.g. a substantially flat state of the actuator membrane 32.

In the neutral stage, the pressure in the pressure chamber may be maintained stationary, for example, or at least no pressure wave is generated in the pressure chamber 12. For example, the neutral stage may be a stand-by mode of the actuator membrane 32, in which the first and second voltages applied to the first and second respective piezoelectric parts 22, 24 are maintained at a constant level. Furthermore, for example, the neutral stage may provide for a polarization process, in which at least one of the first voltage and the second voltage are selected to have a value such that the polarization of the respective piezoelectric part is increased. Depending on the piezoelectric material, providing first and second voltages for increasing and/or maintaining a polarization of a respective piezoelectric part 22, 24 may increase the deflection efficiency in a following activation stage.

In the activation stage, the control unit 34 applies a signal S2 to the signal electrode 26, corresponding to a voltage level that is closer to the +40 V of the second constant potential electrodes 30 than to ground. Thus, the first voltage and the second voltage are varied in accordance with a waveform schematically illustrated in FIG. 3. For example, the activation stage comprises applying a signal in the form of a voltage pulse to the signal electrode 26. The voltage level of the signal is limited by the voltage levels of the first and second constant potential electrodes 28, 30. Therefore, a polarity of the first voltage is not reversed during applying the pulse, and, similarly, a polarity of the second voltage is not reversed during applying the pulse. Therefore, although the change in the electric fields in the first and second piezoelectric parts 22, 24 is in the same direction for the first and second piezoelectric parts, and, thus, against the direction of the polarization in the second piezoelectric parts 24, the resulting net electric fields in the first and second piezoelectric parts 22, 24 are always in the direction of the polarization. Therefore, a deterioration of the polarization can be avoided both in the first and second piezoelectric parts.

Figure 2:
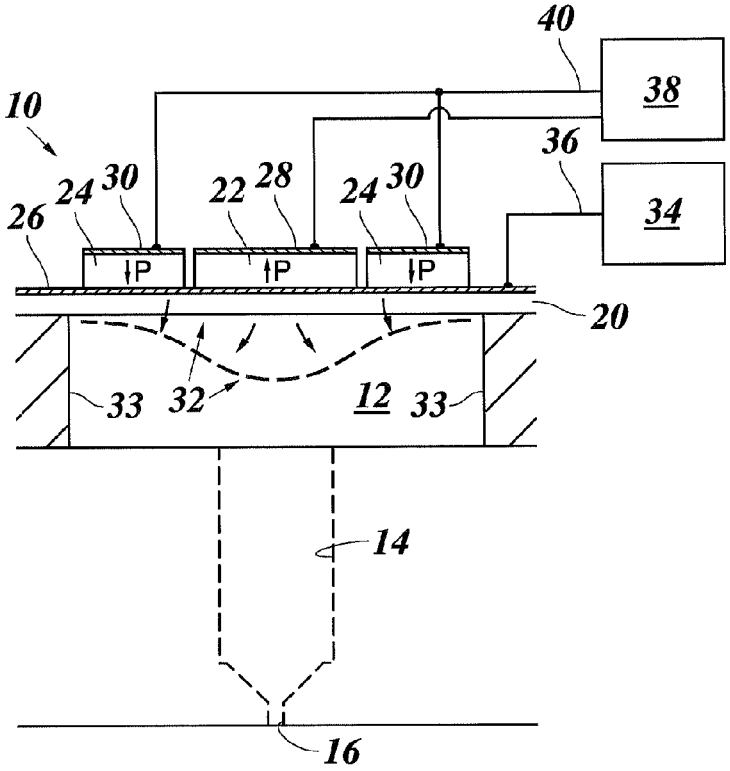
FIG. 2 is a schematic view corresponding to FIG. 1, wherein the actuator membrane is deflected.

However, when the voltage level of the signal raises from S1 to S2, the first piezoelectric parts 22 is contracted in its lateral direction, whereas the second piezoelectric parts 24 undergo an extension in lateral direction. As a result, the curvature of the central part of the actuator membrane 32 is changed in a first direction, e.g. a positive direction, corresponding to a convex shape at the pressure chamber side, whereas the curvature of the peripheral parts of the actuator membrane 32 is changed in the opposite, e.g. negative, direction, corresponding to a concave shape on the pressure chamber side. Thus, during applying of the pulse, the actuator membrane 32 may assume a second flexure state as schematically illustrated by a dashed line in FIG. 2. Seen from the pressure chamber side, the concave shape of the peripheral parts of the actuator membrane 32 supports the convex shape of the central part, thereby providing an increased deflection amount of the central part of the actuator membrane 32. Thus, the efficiency of providing a pressure wave in a fluid in the pressure chamber is increased. For example, lower voltages may be required than with conventional designs, and energy may be saved. In particular, for example, lower first and second voltages may be required for actuation, while maintaining the polarization in both the first and second piezoelectric parts. Therefore, the durability of the actuator may be improved.

In the described example, during the activation stage, an absolute value of the first voltage is temporarily increased, and an absolute value of the second voltage is temporarily decreased, but without reversing the polarity of the first voltage and without reversing the polarity of the second voltage. Correspondingly, the field intensity of the field in the first piezoelectric part 22 is temporarily increased, whereas the field intensity of the field in the second piezoelectric parts 24 is temporarily decreased.

In the described example, the waveform of the signal pulse applied to the signal electrode 26 in the activation stage is a square waveform. However, a different waveform may be used, shaped in accordance with a required pressure wave shape to optimize droplet formation. For example, the steepness of the flanges of the signal pulse has influence on the formation of a pressure wave in the pressure chamber.

For example, the bending ability of the first and/or second piezoelectric parts 22, 24 may easily be improved by selecting a higher bias voltage. Furthermore, for example, a lower limit of the signal voltage level S1 may be set to the lower voltage level of the bias voltage, i.e. ground or 0 V in the example described. Furthermore, for example, an upper limit of the signal voltage level S2 may be set to the upper voltage level of the bias voltage, i.e. +40 V in the described example.

Figure 4:
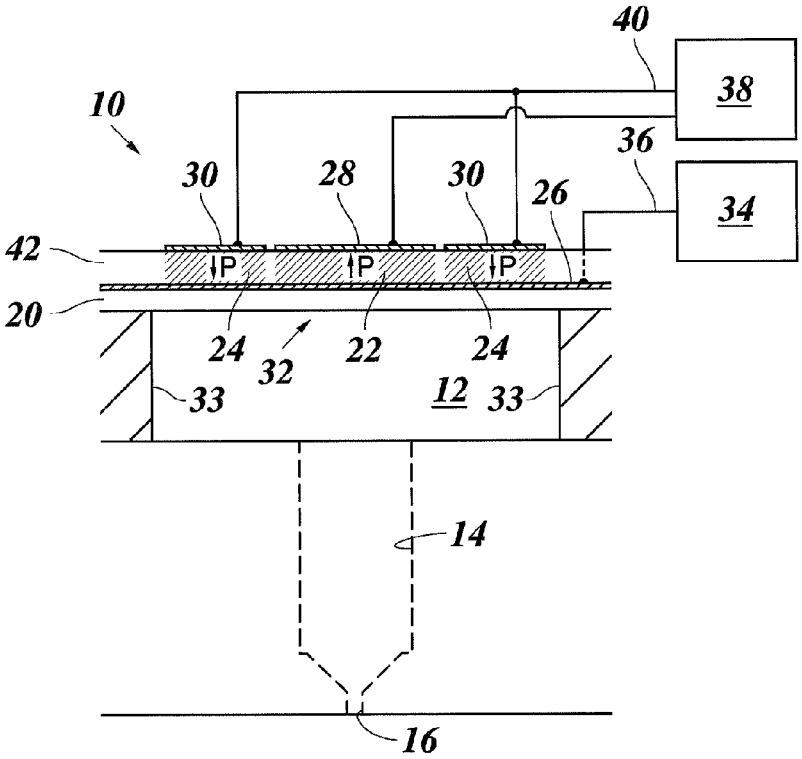
FIG. 4 is a schematic view of a further embodiment.

FIG. 4 shows a modified embodiment of the example of FIG. 1. In this embodiment, the actuator membrane 32 comprises a single piezoelectric layer element 42, comprising the first and second piezoelectric parts 22, 24 arranged next to each other. In particular, the element 42 is partly polarized in a first direction for providing the first piezoelectric part 22 and is partly polarized in a second, opposite direction for providing the second piezoelectric parts 24. The configuration of the signal electrode 26 and the first and second constant potential electrodes 28, 30 is similar to that of FIG. 1.

Figure 5:
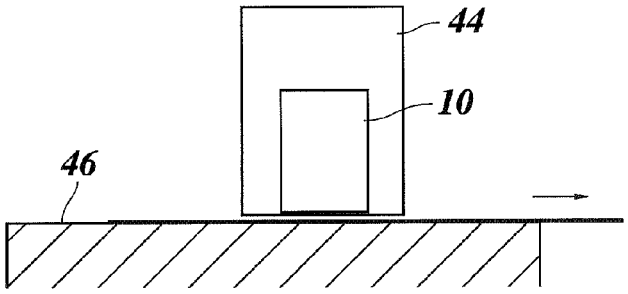
FIG. 5 is a schematic partial view of a printing device.

FIG. 5 schematically shows a print head 10 of the printing device, which is mounted on a print head carriage 44 to reciprocate above a printing medium support surface 46. The carriage 44 is equipped with at least one print head 10 for printing on a printing medium that is conveyed through a gap between the support surface 46 and the carriage 44.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

The invention claimed is:

1. A method of controlling a pressure of a fluid in a pressure chamber, which pressure chamber is delimited by an actuator membrane, wherein the actuator membrane comprises a first piezoelectric part arranged in a central part of the actuator membrane and at least one second piezoelectric part arranged in at least one peripheral part of the actuator membrane, the method comprising:

a neutral stage for providing a first flexure state of the actuator membrane, the neutral stage comprising: applying a first voltage to the first piezoelectric part, thereby generating a first electric field in the first piezoelectric part; and applying a second voltage to the second piezoelectric part, thereby generating a second electric field in the second piezoelectric part; and an activation stage for temporarily providing a second flexure state of the actuator membrane, the activation stage comprising: temporarily varying the first voltage and the second voltage, without reversing a polarity of the first voltage and without reversing a polarity of the second voltage, such that a curvature of the central part of the actuator membrane and a curvature of the at least one peripheral part of the actuator membrane are changed in opposite directions, and a pressure wave is generated in the pressure chamber to expel a droplet of an ink supplied to the pressure chamber, wherein the first piezoelectric part is arranged over the pressure chamber in a central portion of the pressure chamber, and the second piezoelectric part is at least partially arranged over the pressure chamber, and wherein the curvature of the central part of the actuator membrane and the curvature of the at least one peripheral part of the actuator membrane are caused by the corresponding piezoelectric part extending or contracting in a lateral direction parallel to the actuator membrane.

2. The method according to claim 1, wherein the actuator membrane comprises at least one membrane layer, the first and second piezoelectric parts being arranged on one side of said at least one membrane layer.

3. The method according to claim 2, wherein the first and second piezoelectric parts are polarized in mutually opposite directions.

4. The method according to claim 1, wherein the first and second piezoelectric parts thicknesses of at most 5 μm.

5. The method according to claim 1, wherein the activation stage comprises: temporarily decreasing an absolute value of one of the first voltage and the second voltage, and temporarily increasing an absolute value of the other one of the first voltage and the second voltage, without reversing a polarity of the first voltage and without reversing a polarity of the second voltage, such that a curvature of the central part of the actuator membrane and a curvature of the peripheral part of the actuator membrane are changed in opposite directions.

6. The method according to claim 1, wherein the actuator membrane comprises a first constant potential electrode, at least one second constant potential electrode, and a signal electrode, wherein the first piezoelectric part is arranged between the first constant potential electrode and the signal electrode, and wherein the second piezoelectric part is arranged between the second constant potential electrode and the signal electrode.

7. The method according to claim 6, comprising applying a bias voltage between the first and second constant potential electrodes, and comprising applying a signal to the signal electrode that is limited to a range from a constant potential of the first constant potential electrode to a constant potential of the second constant potential electrode.

8. The method according to claim 1, wherein the first and second piezoelectric parts are polarized in mutually opposite directions.

9. The method according to claim 1, wherein the pressure chamber is in fluid communication with a nozzle, and wherein, in the activation stage, the first voltage and the second voltage are temporarily varied such that a resulting pressure wave in the pressure chamber provides for expelling a droplet of fluid through said nozzle.

10. The method according to claim 1, wherein the first and second piezoelectric parts thicknesses of at most 10 μm.

11. An ink jet printing device, comprising:

a pressure chamber, an actuator membrane delimiting the pressure chamber, wherein the actuator membrane comprises a first piezoelectric part arranged in a central part of the actuator membrane and at least one second piezoelectric part arranged in at least one peripheral part of the actuator membrane, and a control unit arranged for applying a first voltage to the first piezoelectric part and applying a second voltage to the second piezoelectric part, for providing a first flexure state of the actuator membrane, wherein the control unit is arranged for temporarily varying the first voltage and the second voltage, without reversing a polarity of the first voltage and without reversing a polarity of the second voltage, such that a curvature of the central part of the actuator membrane and a curvature of the at least one peripheral part of the actuator membrane are changed in opposite directions, thereby temporarily providing a second flexure state of the actuator membrane, and generating a pressure wave in the pressure chamber to expel a droplet of an ink supplied to the pressure chamber, wherein the first piezoelectric part is arranged over the pressure chamber in a central portion of the pressure chamber, and the second piezoelectric part is at least partially arranged over the pressure chamber, and wherein the curvature of the central part of the actuator membrane and the curvature of the at least one peripheral part of the actuator membrane are caused by the corresponding piezoelectric part extending or contracting in a lateral direction parallel to the actuator membrane.

12. The ink jet printing device according to claim 11, wherein the control unit is adapted to perform a method of controlling a pressure of a fluid in a pressure chamber, which pressure chamber is delimited by an actuator membrane, wherein the actuator membrane comprises a first piezoelectric part arranged in a central part of the actuator membrane and at least one second piezoelectric part arranged in at least one peripheral part of the actuator membrane, the method comprising:

a neutral stage for providing a first flexure state of the actuator membrane, the neutral stage comprising: applying a first voltage to the first piezoelectric part, thereby generating a first electric field in the first piezoelectric part; and applying a second voltage to the second piezoelectric part, thereby generating a second electric field in the second piezoelectric part; and an activation stage for temporarily providing a second flexure state of the actuator membrane, the activation stage comprising: temporarily varying the first voltage and the second voltage, without reversing a polarity of the first voltage and without reversing a polarity of the second voltage, such that a curvature of the central part of the actuator membrane and a curvature of the at least one peripheral part of the actuator membrane are changed in opposite directions.

13. The ink jet printing device according to claim 11, wherein said temporarily varying the first voltage and the second voltage comprises: temporarily decreasing an absolute value of one of the first voltage and the second voltage, and temporarily increasing an absolute value of the other one of the first voltage and the second voltage, without reversing a polarity of the first voltage and without reversing a polarity of the second voltage, such that a curvature of the central part of the actuator membrane and a curvature of the peripheral part of the actuator membrane are changed in opposite directions.

14. The ink jet printing device according to claim 11, wherein the actuator membrane comprises a first constant potential electrode, at least one second constant potential electrode, and a signal electrode that is connected to the control unit, wherein the first piezoelectric part is arranged between the first constant potential electrode and the signal electrode, and wherein the second piezoelectric part is arranged between the second constant potential electrode and the signal electrode, and wherein the ink jet printing device further comprises a bias voltage supply unit connected to the first and second constant potential electrodes for providing a bias voltage between the first and second constant potential electrodes, and wherein the control unit is adapted to at least temporarily provide a signal to the signal electrode for providing said first voltage between the first constant potential electrode and the signal electrode, and providing said second voltage between the second constant potential electrode and the signal electrode.

15. The ink jet printing device according to claim 11, wherein the actuator membrane comprises at least one membrane layer, the first and second piezoelectric parts being arranged on one side of said at least one membrane layer.

16. The ink jet printing device according to claim 11, wherein the first and second piezoelectric parts are polarized in mutually opposite directions.

17. The ink jet printing device according to claim 11, wherein the pressure chamber is in fluid communication with a nozzle, and wherein the control unit is arranged for temporarily varying the first voltage and the second voltage, without reversing a polarity of the first voltage and without reversing a polarity of the second voltage, such that a resulting pressure wave in a fluid in the pressure chamber provides for expelling a droplet of fluid through said nozzle.

18. The method according to claim 2, wherein the activation stage comprises: temporarily decreasing an absolute value of one of the first voltage and the second voltage, and temporarily increasing an absolute value of the other one of the first voltage and the second voltage, without reversing a polarity of the first voltage and without reversing a polarity of the second voltage, such that a curvature of the central part of the actuator membrane and a curvature of the peripheral part of the actuator membrane are changed in opposite directions.

19. The method according to claim 2, wherein the actuator membrane comprises a first constant potential electrode, at least one second constant potential electrode, and a signal electrode, wherein the first piezoelectric part is arranged between the first constant potential electrode and the signal electrode, and wherein the second piezoelectric part is arranged between the second constant potential electrode and the signal electrode.

20. The method according to claim 5, wherein the actuator membrane comprises a first constant potential electrode, at least one second constant potential electrode, and a signal electrode, wherein the first piezoelectric part is arranged between the first constant potential electrode and the signal electrode, and wherein the second piezoelectric part is arranged between the second constant potential electrode and the signal electrode.

* * * * *